US006010339A

United States Patent [19]

McDonald

[11] Patent Number: 6,010,339

[45] Date of Patent: Jan. 4, 2000

[54] TOY TELEPHONE HAVING PHONE NUMBER TEACHING SYSTEM

[75] Inventor: David Lewis McDonald, Foothill Ranch, Calif.

[73] Assignee: Mattel, Inc., El Segundo, Calif.

[21] Appl. No.: 09/240,898

[22] Filed: Jan. 29, 1999

[51] Int. Cl.[7] ..... G09B 19/00

[52] U.S. Cl. ..... 434/258; 434/247; 434/335; 434/337; 446/484

[58] Field of Search ..... 434/319, 169, 434/247, 258, 308, 309, 321, 322, 314, 379; 446/141, 142, 143, 397, 417, 491; 463/7, 30, 31

[56] References Cited

U.S. PATENT DOCUMENTS

| | | | |
|---|---|---|---|
| 2,500,507 | 3/1950 | Avery et al. . | |
| 2,582,096 | 1/1952 | Bessell . | |
| 3,958,344 | 5/1976 | Lesiak . | |
| 4,103,452 | 8/1978 | Wood . | |
| 4,104,821 | 8/1978 | Nakajima . | |
| 4,228,596 | 10/1980 | Daniel | 434/344 |
| 4,508,511 | 4/1985 | McQueen | 434/258 |
| 5,026,288 | 6/1991 | Castiglia et al. | 434/169 |
| 5,184,971 | 2/1993 | Williams . | |
| 5,474,484 | 12/1995 | Lemelle . | |
| 5,513,993 | 5/1996 | Lindley et al. . | |
| 5,609,508 | 3/1997 | Wingate . | |
| 5,910,009 | 6/1999 | Leff | 434/322 |

*Primary Examiner*—Robert A. Hafer
*Assistant Examiner*—Bena B. Miller
*Attorney, Agent, or Firm*—Roy A. Ekstrand

[57] ABSTRACT

A housing supports a keypad having a four by three matrix of depressible buttons each baring an appropriate number or symbol in correspondence to the four by three arrangement of a conventional telephone dial pad. The housing further supports a pageable book having a plurality of pivotally secured pages each baring a selected image and corresponding number. A simulated telephone hand unit is secured to the housing by a safety cord and is receivable within a cradle formed in the housing. Each depressible button includes a lighting device and a push button switch in association therewith. The depressible button operates the switch when the button is pressed and the button is illuminated when the light is energized. An electronic circuit within the housing operates the plurality of switches and lights associated with the plurality of buttons in accordance with a stored instruction set.

3 Claims, 3 Drawing Sheets

TOY TELEPHONE HAVING PHONE NUMBER TEACHING SYSTEM

FIELD OF THE INVENTION

This invention relates generally to toy telephones and particularly to those utilizing various light and sound devices for added realism and play value.

BACKGROUND OF THE INVENTION

Toy telephones have proven to be an extremely popular category of toy products. For the most part, such toy telephones generally mimic conventional telephones of the type used in home phone systems. Thus, toy telephones have been provided by practitioners in the art having various ring functions, talking functions, light displays and phone dialing apparatus. With the advent of touch tone phones the dialing apparatus is generally replaced by types of push buttons similar to the tone operated telephones in the household system.

In addition to entertainment and amusement, toy telephones have often been provided with additional apparatus which provides an instructive or teaching play pattern. For example, U.S. Pat. No. 5,513,993 issued to Lindley et al. sets forth an EDUCATIONAL 911 TRAINING DEVICE having a toy telephone resembling a standard telephone which is operable in accordance with a controlling processor to repeat, evaluate and instruct a child user in the proper dialing of the emergency number (911).

U.S. Pat. No. 5,184,971 issued to Williams sets forth a TOY TELEPHONE RECORDER WITH PICTURE ACCUATED RECORDING AND PLAY BACK having a toy telephone equipped with a recorder operable by a plurality of push button assemblies. Depressing one of the push button assemblies produces a play back of a particular message stored in the recorder.

U.S. Pat. No. 4,103,452 issued to Wood sets forth a CHILDS TELEPHONE APPARATUS which is selectively connectable to home stereophonic sound systems. The telephone functions as a talking toy which utilizes for example a stereophonic sound system requiring a play back on two separate speakers.

U.S. Pat. No. 4,104,821 issued to Nakajima TOY TELEPHONE WITH BELL AND RECORDED MESSAGES having a recording device supported within a toy telephone. A plurality of recorded messages are stored therein. The toy telephone is capable of producing ringing sounds in accordance with a predetermined play pattern.

U.S. Pat. No. 5,609,508 issued to Wingate sets forth a TOY TELEPHONE WITH VISUAL DISPLAY FOR RECORDED MESSAGES having a toy telephone supporting an LCD display enabling an audio and image data to be recorded by parents or the like and to play such data back in response to manipulation of the buttons within the numeric keypad of the toy telephone.

U.S. Pat. No. 2,582,086 issued to Bessell sets forth a TOY TELEPHONE having a conventional telephone base and telephone receiving cradle. The toy further includes a finger dial apparatus and a ringing apparatus. The toy phone is operative to mimic the functions of a conventional phone.

U.S. Pat. No. 5,474,484 issued to Lemelle sets forth a DOLL USED TO TEACH CHILDREN TO USE THE EMERGENCY 911 TELEPHONE NUMBERS having a conventional doll supporting a toy telephone in the upper portion of the doll torso. The toy phone includes a tape player having pre-recorded tape of the words likely to be used by and emergency dispatcher at a 911 number, as the user pushes the sequence of buttons for 911 emergency the recorded tape is activated.

Several other devices operate in a similar manner using apparatus similar to the push button arrays of toy telephones for teaching purposes. For example, U.S. Pat. No. 3,958,344 issued to Lesiak sets forth a TEACHING AIDE FOR TEACHING NUMBERS: U.S. Pat. No. 5,026,288 issued to Castiglia et al. sets forth ILLUMINATED EDUCATIONAL BLOCKS while U.S. Pat. No. 2,500,507 issued to Avery et al. sets forth an APPARATUS FOR TEACHING FOR TYPEWRITING having a secondary keyboard configured in accordance with a conventional typewriting keyboard.

While the foregoing described prior art devices have provided improvement in the art and have in some instances enjoyed commercial success, there remains nonetheless a continuing need in the art for evermore improved amusing, entertaining and effective apparatus for teaching critical phone numbers to a young child.

SUMMARY OF THE INVENTION

Accordingly, it is a general object of the present invention to provide an improved toy telephone. It is a more particular object of the present invention to provide an improved toy telephone having a phone number teaching system. It is a still more particular object of the present invention to provide an improved toy telephone having a phone number teaching system which is particularly suited to vary young children.

In accordance with the present invention there is provided a toy telephone comprising: a housing having cradle and hand unit receivable therein and an interior. A keypad formed upon the housing having a plurality of depressible buttons, each formed of a light transmissive material, arranged upon the housing in a four row by three column matrix, the depressible buttons each having a symbol or number thereon and a downwardly extending post; a plurality of lights supported by the housing, one of the lights being supported beneath a selected one of the depressible buttons; a plurality of push button switches supported by the housing, one of the push button switches being supported beneath a selected one of the depressible buttons, each of the push button switches being supported beneath its respective one of the posts; a plurality of hinges each pivotally coupling one of the plurality of push buttons to the housing to define a raised position and a depressed position; and circuit means having a processor having an associated memory storing an instruction set, light driver matrix having an input coupled to the processor and a plurality of outputs coupled to the plurality of lights for selective exchanging each light, a switch matrix having an output coupled to the processor and a plurality of inputs coupled to the plurality of push button switches for selectively sensing each push button switch closure, and a program switch couple to the processor to select a program mode, the stored instruction set responding to the program mode to receive a home phone number inputted by the user and thereafter repeatedly lighting the lights in sequence corresponding to the telephone number and sensing whether a corresponding push button is depressed, whereby the toy telephone is able to receive, store and present a home phone number and sense a correct or incorrect push button depression on a repetitive basis to teach the user a home phone number.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
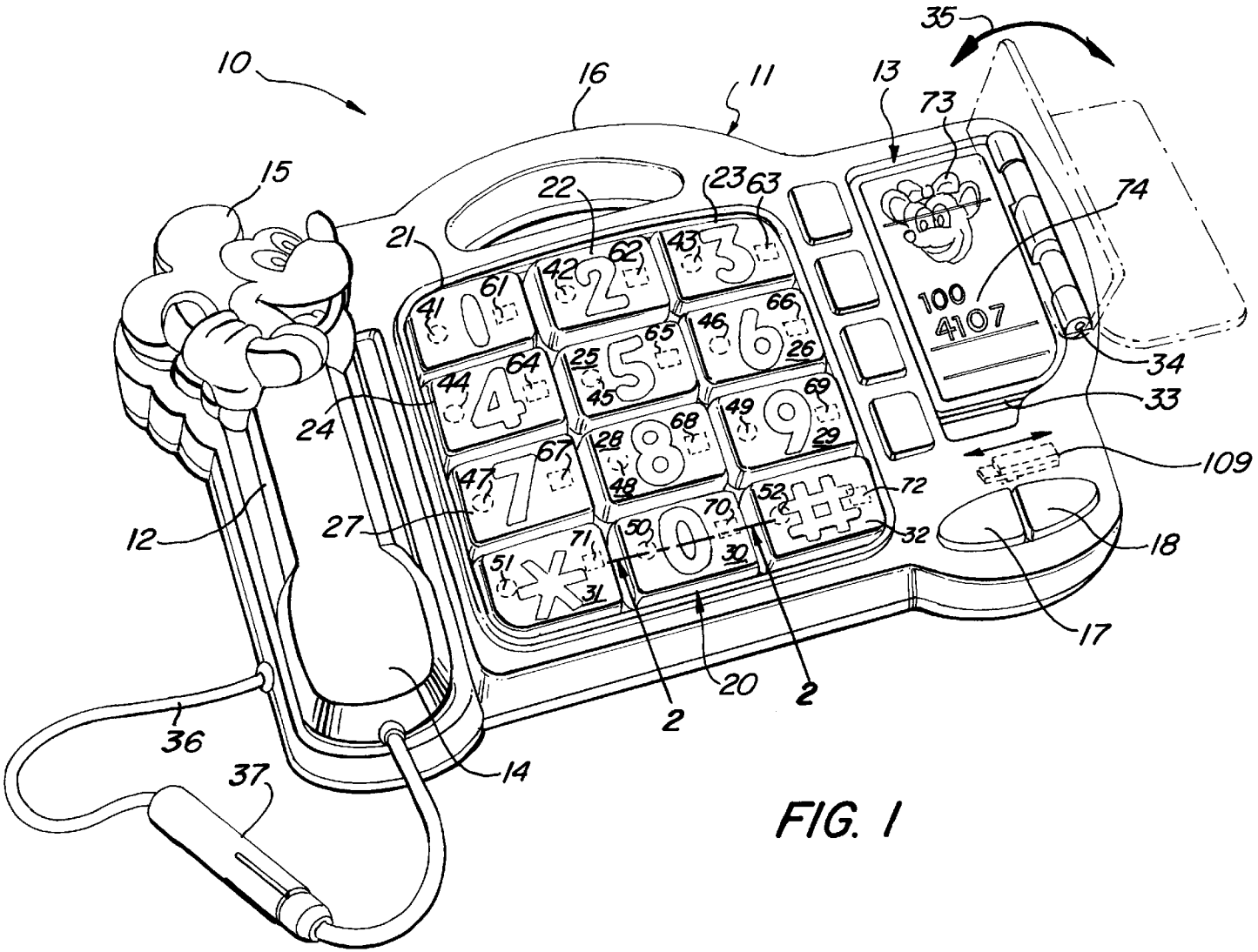
FIG. 1 sets forth a perspective view of a toy constructed in accordance with the present invention.

FIG. 1 sets forth a perspective view of a toy telephone constructed in accordance with the present invention and generally referenced by numeral 10. Toy telephone 10 includes a housing 11 preferably formed of a molded plastic material or the like. Housing 11 defines a handle 16 a hand set cradle 12 and a multiple page book 13. Housing 11 further supports a keypad 20 having a plurality of push buttons arranged in a conventional telephone keypad 3 by 4 matrix. In further accordance with telephone keypad characteristics push buttons 21 through 50 correspond sequentially to numerals 1 through 0. Further keypad 31 corresponds to the "star" key while push button 32 corresponds to the "pound" key. Thus the array of buttons and numbers and symbols thereon is to the child user a substantially enlarged version of a touch tone telephone keypad.

A simulated telephone hand unit 14 includes a character relief 15 and is received within cradle 12. A simulated telephone cord 36 having a safety connector 37 therein connects hand unit 14 to housing 11. Cord 36 is not an electrical conductor and is intended merely to simulate the typical telephone cord. Housing 11 further supports a pair of mode buttons 17 and 18 operative in the manner described below.

In accordance with the present invention, each of button of buttons 21 through 32 is provided with a corresponding underlying light element such as an incandescent bulb. Thus, buttons 21 through 32 are operatively coupled to a corresponding plurality of lamps 41 through 52. In addition, each of push buttons 21 through 32 is mechanically coupled by means set forth below in FIGS. 2 and 3 in greater detail to a corresponding plurality of push button switches 61 through 72. The operative mechanisms which support the incandescent lamps and which are coupled between push buttons 21 through 32 and switches 61 through 72 are substantially identical. Thus, with temporary reference to FIGS. 2 and 3 it will be noted that each of buttons 21 through 32 are illuminateable by there respective lamps and pressing each of buttons 21 though 32 actuates a corresponding 1 of switches 61 through 72 in accordance with the circuit shown in FIG. 4.

Thus, each of buttons 21 through 32 is independently illuminateable and is independently depressible in accordance with the anticipated play pattern of the present invention toy telephone. Mode button 17 is operative to switch the operation of circuit 100 (seen in FIG. 4) which is supported within the interior of housing 11 using conventional fabrication techniques (not shown) in a selected mode of operation. Similarly, mode button 18 when pushed operates circuit 100 (seen in FIG. 4) in an alternative mode of operation.

In the operation of toy telephone 10 selected by pressing mode button 17, circuit 100 (seen in FIG. 4) randomly selects a number sequence, preferably a telephone number, and sequentially lights the corresponding ones of buttons 21 though 32. A corresponding audio prompt which speaks the operative numbers as each push button is lighted is also operative. The child user attempts to push each button as the button is lighted and is thereby directed towards associating the number and position within keypad 20 of each button. Thus in response to mode button 17 a sequence of lights are activated to illuminate to a corresponding sequence of buttons which the child attempts to follow. In the preferred embodiment of the present invention the number associated with a lighted button is spoken by sound circuit 106 (seen in FIG. 4). In this fashion, the electronic circuit within housing 11 operates in response to mode button 17 to repeatedly expose the child user to the numbers and keypad position of the numbers within keypad 20 producing a highly efficient learning aid directed specifically toward the same keypad arrangement found in a conventional telephone.

Telephone toy 10 is operable in an alternate mode in response to pressing button 18 which causes the electronic circuit within housing 11 (circuit 100 seen in FIG. 4) to operate specifically to teach the child user his or her home telephone number. Toward this end and is as described below in greater detail, a program switch 109 (seen in FIG. 4) is moved to the program position allowing the parent or other adult to program in the child's phone number which is sought to be memorized. The operation of program switch 109 (seen in FIG. 4) is described below in greater detail. However, suffice it to note here that the parent is able to input a selected number such as a home phone number and thereafter that number be controlling in the operation of teaching as the buttons associated with each digit of the phone number are sequentially operated. As is also described below in greater detail, once the parent has programmed the home phone number or the like, program switch 109 is returned to the locked or non-programming position. For purposes of convenience and to avoid undesired manipulation of the program switch by the child user, program switch 109 is preferably supported upon the rear surface of housing 11 and thus is shown in FIG. 1 in dash line representation. It will be apparent however, that switch 109 may be located virtually anywhere on toy 10 without departing from the spirit and scope of the present invention.

Housing 11 further supports a book 13 formed of a plurality of pages 33 each pivotally moveable upon hinge 34 in the manner indicated by arrows 35. Pages 33 of book 13 may for example include the combination of an image such as character image 73 together with a sequence of numeric digits such as phone number 74. In this manner the child user is encouraged to learn the activity of paging through a book to obtain the number of a character having its number and image associated on a common page. This adds a further teaching capability for the present invention toy telephone. In correspondence with a conventional telephone, hand unit 14 is removable from cradle 12 and is generally configured in accordance with a conventional telephone hand unit adding further play value and realism to the present invention toy telephone.

Figure 2:
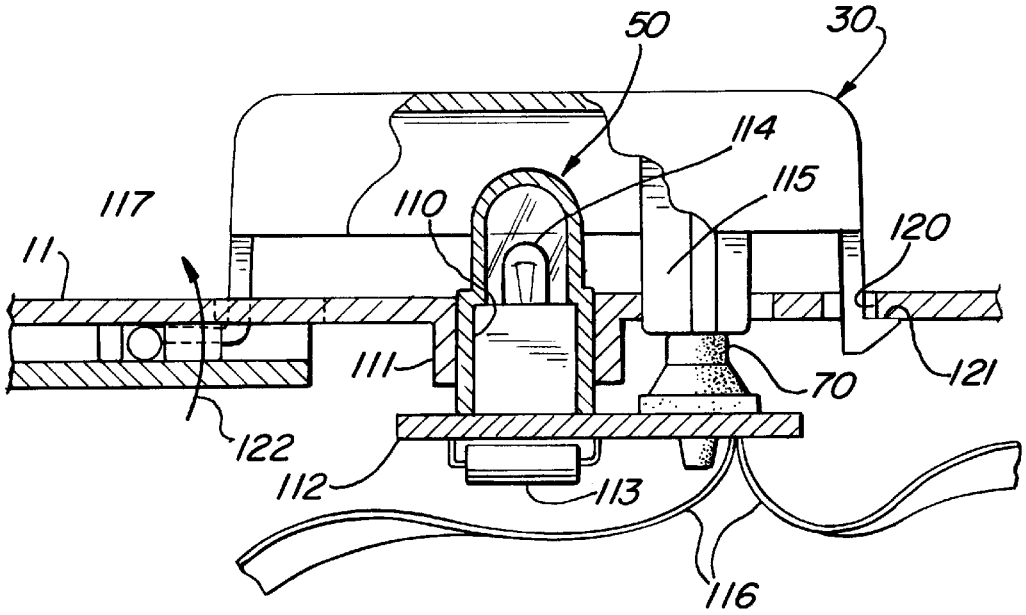
FIG. 2 sets forth a partial broken section view of a push button and light apparatus of the present invention of the toy telephone taken along section lines 2—2 in FIG. 1.

FIG. 2 sets forth a partial broken section view of button 30 taken along section lines 2—2 in FIG. 1. By way of overview, shows button 30 in its normal or raised position. It will be understood that the structure of button 30 and its associated apparatus is repeated for the remaining buttons having corresponding association within keypad 20 (seen in FIG. 1). Thus the structure set forth in FIGS. 2 and 3 herein for button 30 will be understood to be equally descriptive and apply with equal force to buttons 21 through 29 and buttons 31 and 32 together with there corresponding associated apparatus.

More specifically, housing 11 includes a hinge 117 extending from button 30 and pivotally supporting button 30 with respect to housing 11. Button 30 further defines a downwardly extending tab 121 which passes through a aperture 120 formed in housing 11. A socket 111 having an aperture 110 is integrally formed with housing 11 and extends downwardly therefrom. Button 30 further includes a downwardly extending post 115. A printed circuit board 112 supports a light 50 having an incandescent bulb 114 supported upon an electrically coupled to circuit board 112. A resister 113 spans bulb 114 for overcurrent protection. Printed circuit board 112 further includes a depressible switch 70 positioned in alignment with post 115. A plurality of connecting cables such as cable 116 preferably formed of a "ribbon cable" provide electrical connections between bulb 114, resister 113 and switch 70. In the preferred fabrication of the present invention switch 70 is of conventional fabrication and includes a return spring urging the depressible member of switch 70 upwardly against 115. Further in the preferred fabrication of the present invention button 30 is molded of a colored light transmissive material such as molded plastic or the like.

In the configuration shown in FIG. 2 button 30 is in its raised position as it is pivoted upwardly in the direction indicated by arrow 122 about hinge 117 due to the return force of switch 70 exerted against post 115 in the upward direction. The raised position of button 30 is limited by the contact of tab 121 against the underside of housing 11 beyond aperture 120. In the raised position shown, bulb 114 may be illuminated by appropriate energizing signals applied via cable 116 as desired. However, in the raised position shown switch 70 is inoperative. Thus the use of bulb 114 and switch 70 together with the cooperating features of button 30 facilitate the independent lighting of button 30 and response to the pressing of button 30.

Figure 3:
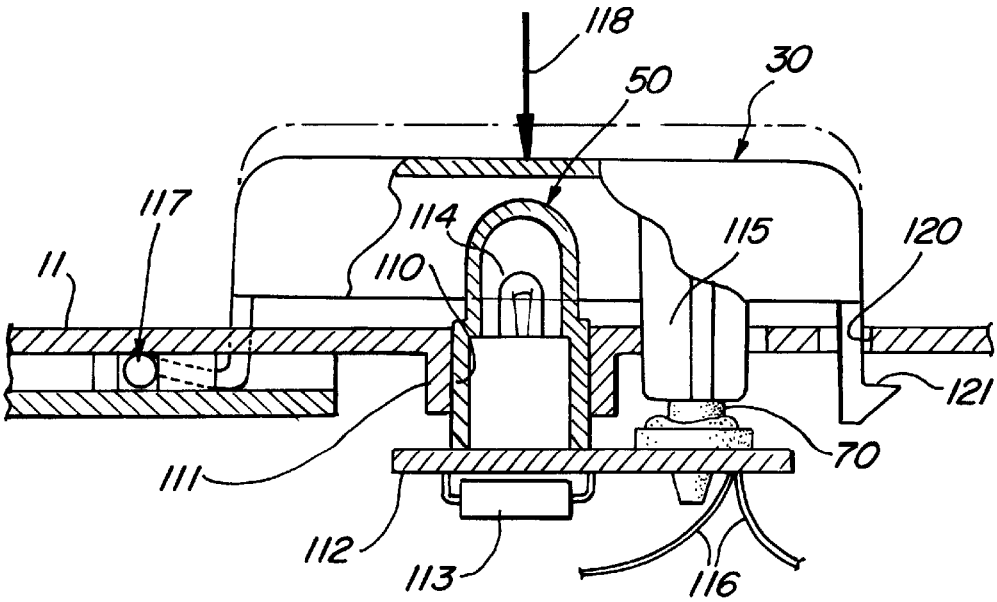
FIG. 3 sets forth the section view of FIG. 2 in the push button activated configuration.

FIG. 3 sets forth a partial broken section view of button 30 and its associated apparatus taken along section lines 2—2 in FIG. 1. In FIG. 3, button 30 is shown having been depressed by a user exerting a downward force upon button 30. Of importance with respect to the present invention is the cooperation of post 115, hinge 117 and switch 70 to provide communication of the button pressing action to circuit 100 (seen in FIG. 4).

More specifically, housing 11 includes a hinge 117 extending from button 30 and pivotally supporting button 30 with respect to housing 11. Button 30 further defines a downwardly extending tab 121 which passes through a aperture 120 formed in housing 11. A socket 111 having an aperture 110 is integrally formed with housing 11 and extends downwardly therefrom. Button 30 further includes a downwardly extending post 115. A printed circuit board 112 supports a light 50 having an incandescent bulb 114 supported upon an electrically coupled to circuit board 112. A resister 113 spans bulb 114 for overcurrent protection. Printed circuit board 112 further includes a depressible switch 70 positioned in alignment with post 115. A plurality of connecting cables such as cable 116 preferably formed of a "ribbon cable" provide electrical connections between bulb 114, resister 113 and switch 70. In the preferred fabrication of the present invention switch 70 is of conventional fabrication and includes a return spring urging the depressible member of switch 70 upwardly against 115. Further in the preferred fabrication of the present invention button 30 is molded of a colored light transmissive material such as molded plastic or the like.

In operation the user presses downwardly in the direction indicated by arrow 118 overcoming the return force of switch 70 and causing button 30 to pivot about hinge 117. Tab 121 is moved downwardly from housing 11 as button 30 pivots. Post 115 is supported by button 30 and thus is moved downwardly during the pivotal motion of button about hinge 117 actuating switch 70. Switch 70 is shown fully depressed or activated by the pivoted downward position of button 30. As is described below in greater detail, the independent coupling of switch 70 and bulb 114 beneath button 30 facilitate the lighting of bulb 114 and actuation of switch 70 independent of each other to enhance the flexibility of the present invention device.

Once the force upon button 30 is removed, the restoring force of switch 70 drives post 115 upwardly pivoting button 30 about hinge 117 so as to raise tab 121 to the undersurface of housing 11. At this point, button 30 and its associated apparatus are returned to the configuration shown in FIG. 2.

Figure 4:
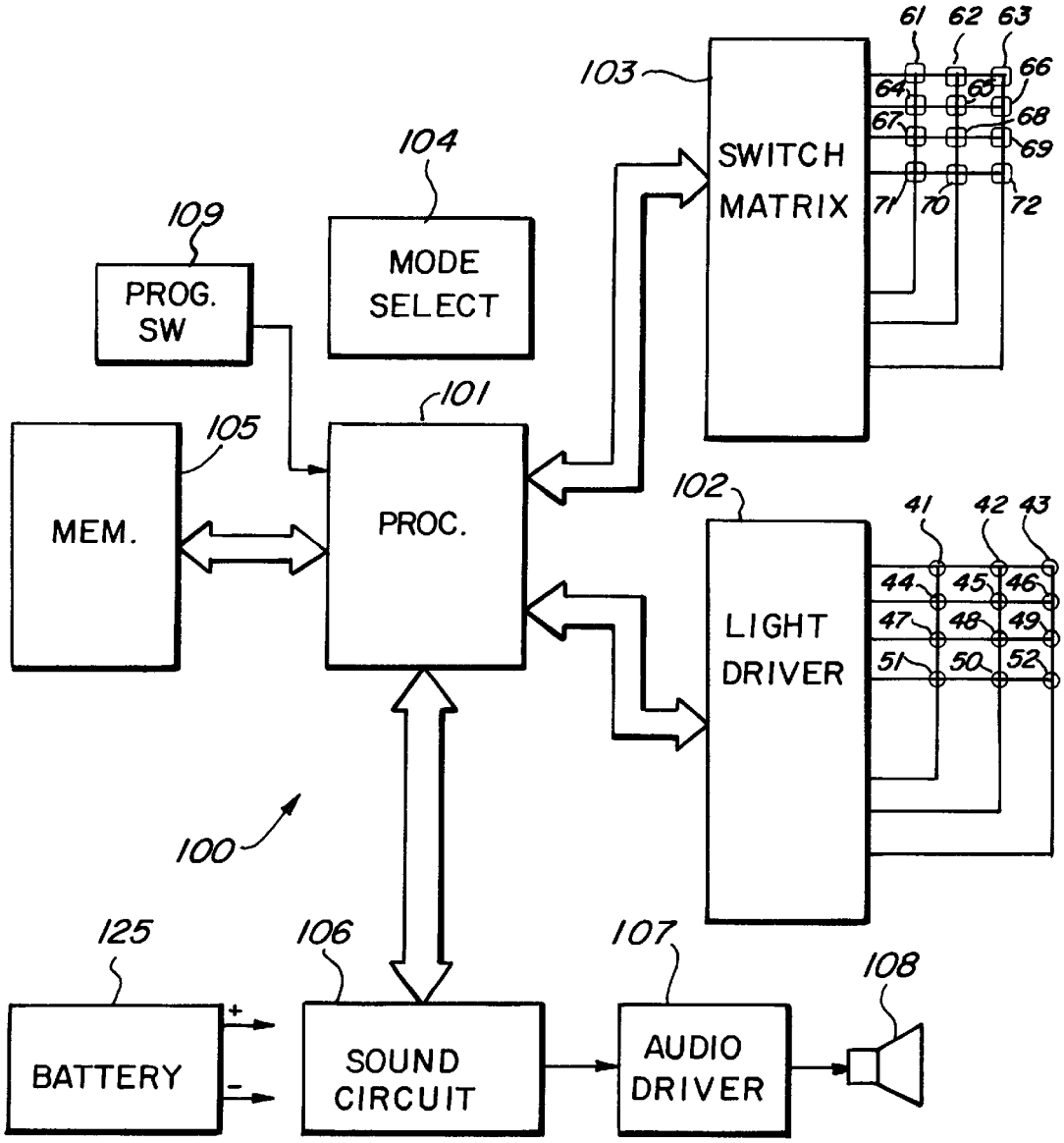
FIG. 4 sets forth a block diagram of the electronic circuit operating the present invention toy telephone.

FIG. 4 sets forth a block diagram of an electronic circuit generally referenced by numeral 100, which is reference within the present invention toy telephone. Circuit 100 includes a processor 101 which in its preferred fabrication is a conventional micro-processor having an associated memory 105 within which an instruction set is stored. Circuit 100 further includes a light driver 102 operatively coupled to processor 101. Light driver 102 includes a four by three matrix arraignment which is operatively coupled to switches 41 through 52 (seen in FIG. 1). Circuit 100 further includes a switch matrix 103 having a plurality of inputs coupled to form a four by three matrix of switches 61 through 72. Switches 61 through 72 correspond to the four by three keypad (seen in FIG. 1) of the present invention toy. Switch matrix 103 is operatively coupled to processor 101.

Circuit 100 further includes a battery supply 125. Battery supply 125 is supported within housing 11 (not shown) in a conventional manner and provides positive and negative electrical terminals which are operatively coupled to circuit 100 in a conventional manner (not shown).

Circuit 100 further includes a sound circuit 106 operatively coupled to processor 101 which produces output signals applied to an audio driver 107. Driver 107 responds to the signals from sound circuit 106 to drive a conventional speaker 108.

A mode select switch 104 is operatively coupled to processor 101 and a program switch 109 is similarly coupled to processor 101. The various devices shown in FIG. 4 utilize well known electronic circuit components utilized for carrying forward the operation of the present invention toy telephone.

In operation, processor 101 is operative in either of two alternative modes in response modes select input 104. With temporary return to FIG. 1 it will be noted that mode buttons 17 and 18 are utilized by the user to operate mode select 104 and configure the operation of processor 101 in a selected mode. The activation of program switch 109 allows the parents of the child user to input a number such as a home phone number to processor 101. In accordance with the instruction set within memory 105, processor 101 stores this number within memory 105.

Thereafter when a mode has been selected, processor 101 responds to a corresponding stored instruction set within memory 105 to apply digitally encoded signals to light driver 102 which in accordance with its matrix configuration decodes the digital input signals and applies energizing signals to the appropriate outputs to illuminate selected lights from lights 41 through 52. Concurrently, processor 101 transfers digitally encoded audio signals to sound circuit 106 which in accordance with conventional fabrication techniques decodes the digital sound signals into appropriate audio signal which in turn are applied to speaker 108 by audio driver 107.

At this point, processor 101 has activated the lights beneath buttons 31 through 52 (seen in FIG. 1) and is outputting corresponding sound such as human speech articulating the numbers corresponding to each lighted bulb. The child user responds to the illumination of bulbs 41 through 52 by pressing selected ones of buttons 21 through 32 (seen in FIG. 1). The pressing of selected ones of buttons 21 through 32 provides activation of the corresponding ones of switches 61 through 72. Matrix 103 includes conventional circuitry for receiving the matrix input of switches pressed and decoding the matrix value to produce corresponding digital signals which are communicated to processor 101. Thereafter, processor 101 utilizes the applied digital signals from switch matrix 103 and the stored instruction set within memory 105 to determine the correctness of child response.

The operation of circuit 100 in each of the alternative modes is carried forward substantially as described above. The functional difference in the operation in each mode is in essence is provided by the activities of processor 101 in determining which number sequence is to be applied to sound circuit 106 and light drivers 102. In the first mode of operation, processor 101 produces a number sequence which may be random, pseudo random or the like for application to light driver 102 and sound circuit 106. In this manner, the above described play pattern is produced where the child user attempts to replicate or repeat the sequence of lighted buttons actuated by processor 101.

In contrast, operation in the alternative mode (initiated by program switch 109) allows a parent to input a selected number such as a home phone number to processor 101 whereby processor 101 stores the selected number sequence within memory 105. Program switch 109 is then moved to the inactive or locked position and processor 101 utilizes the stored number sequence repeatedly to audiolize the number via circuit 106 and sequentially light the appropriate ones of lights 41 through 52. In this mode of operation the child user is repeatedly presented with the number sequence of the phone number and attempts to follow the number sequence by depressing appropriate ones of buttons 21 through 32 (seen in FIG. 1) thereby operating switches 61 through 72. Once again, matrix 103 converts the sequence of switches closed to appropriate digitally encoded signals which are returned to processor 101. Processor 101 then compares the returned numbers with the stored parent supplied numbers within memory 105 and initiates an appropriate response.

What has been shown is a toy telephone specifically adapted and constructed to maximize the teaching capabilities of the device in connection with telephone operation. The child user is encouraged to learn the numbers as well as the positions of each number within a conventional telephone keypad arrangement. Of particular importance with respect to the present invention is the provision of a program mode in which the parent is able to input a selected number such as a home phone number or the like to be taught to the child user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy telephone comprising:

a housing having cradle and hand unit receivable therein and an interior.

a keypad formed upon said housing having a plurality of depressible buttons, each formed of a light transmissive material, arranged upon said housing in a four row by three column matrix, said depressible buttons each having a symbol or number thereon and a downwardly extending post;

a plurality of lights supported by said housing, one of said lights being supported beneath a selected one of said depressible buttons;

a plurality of push button switches supported by said housing, one of said push button switches being supported beneath a selected one of said depressible buttons, each of said push button switches being supported beneath its respective one of said posts;

a plurality of hinges each pivotally coupling one of said plurality of push buttons to said housing to define a raised position and a depressed position; and circuit means having a processor having an associated memory storing an instruction set, light driver matrix having an input coupled to said processor and a plurality of outputs coupled to said plurality of lights for selective exchanging each light, a switch matrix having an output coupled to said processor and a plurality of inputs coupled to said plurality of push button switches for selectively sensing each push button switch closure, and a program switch couple to said processor to select a program mode, said stored instruction set responding to said program mode to receive a home phone number inputted by the user and thereafter repeatedly lighting said lights in sequence corresponding to said telephone number and sensing whether a corresponding push button is depressed, whereby said toy telephone is able to receive, store and present a home phone number and sense a correct or incorrect push button depression on a repetitive basis to teach the user a home phone number.

2. The toy telephone set forth in claim 1 wherein said symbol or number on said push buttons forms a number and symbol array corresponding to a standard telephone keypad.

3. The toy telephone set forth in claim 2 further including sound means for providing music and voice prompts to the user.

* * * * *